US008371898B1

(12) United States Patent
Sinisi

(10) Patent No.: US 8,371,898 B1
(45) Date of Patent: Feb. 12, 2013

(54) SUCTION WALL CLIMBING TOY WITH ARTICULATED BODY SEGMENTS

(76) Inventor: John Sinisi, Warminster, PA (US)

( * ) Notice: Subject to any disclaimer, the term of this patent is extended or adjusted under 35 U.S.C. 154(b) by 13 days.

(21) Appl. No.: 12/830,302

(22) Filed: Jul. 3, 2010

Related U.S. Application Data

(60) Provisional application No. 61/213,716, filed on Jul. 7, 2009.

(51) Int. Cl.
*A63H 33/40* (2006.01)

(52) U.S. Cl. ..... 446/178; 446/277; 446/280; 446/285; 446/294; 446/448; 180/164

(58) Field of Classification Search ..... 446/176–179, 446/199, 269, 272, 292, 274, 276, 277, 279, 446/280, 285, 288, 289, 294, 353, 448
See application file for complete search history.

(56) References Cited

U.S. PATENT DOCUMENTS

| | | | | | |
|---|---|---|---|---|---|
| 81,491 | A * | 8/1868 | Goodwin | 446/276 |
| 1,394,136 | A * | 10/1921 | Ballantyne | 446/193 |
| 1,857,976 | A * | 5/1932 | Rivard | 446/276 |
| 3,010,252 | A * | 11/1961 | Crawford et al. | 446/189 |
| 4,018,002 | A * | 4/1977 | Holden | 446/294 |
| 4,087,931 | A * | 5/1978 | Maurer | 446/280 |
| 4,216,612 | A * | 8/1980 | Erickson et al. | 446/290 |
| 4,259,806 | A * | 4/1981 | Troll | 446/198 |
| 4,669,997 | A * | 6/1987 | Kulesza et al. | 446/183 |
| 4,971,591 | A | 11/1990 | Raviv et al. | |
| 5,014,803 | A * | 5/1991 | Urakami | 180/164 |
| 5,194,032 | A | 3/1993 | Garfinkel | |
| 5,423,708 | A * | 6/1995 | Allen | 446/356 |
| 5,683,285 | A * | 11/1997 | Wong | 446/289 |
| 6,123,600 | A * | 9/2000 | Yuen | 446/437 |
| 2005/0009442 | A1 * | 1/2005 | Chen | 446/269 |
| 2006/0144624 | A1 * | 7/2006 | Clark et al. | 180/65.1 |
| 2009/0117820 | A1 * | 5/2009 | Willett et al. | 446/353 |

* cited by examiner

*Primary Examiner* — Gene Kim
*Assistant Examiner* — John E Simms, Jr.
(74) *Attorney, Agent, or Firm* — LaMorte & Associates, P.C.

(57) ABSTRACT

A suction toy assembly and its method of operation. The suction toy assembly has a chassis. The chassis has a front end, a rear end, side surfaces and a base plate. A fan opening is formed through the base plate. A motorized fan is mounted to draw air through the fan opening from the surrounding area. This creates a low pressure condition under the base. A drive wheel is used to propel the assembly. A linkage element is coupled to the drive wheel. At least one extraneous element is provided that protrudes outwardly away from the chassis as a cantilever. The extraneous elements are articulated by movements of the linkage element when the drive wheel rotates, or the chassis moves. Appendages may be mounted on a flexible member to allow for the illusion of climbing.

16 Claims, 6 Drawing Sheets

SUCTION WALL CLIMBING TOY WITH ARTICULATED BODY SEGMENTS

RELATED APPLICATIONS

This application is a continuation-in-part of U.S. Provisional Patent Application No. 61/213,716, entitled Wall Climbing Figure With Realistic Arm And Leg Action, filed Jul. 7, 2009.

BACKGROUND OF THE INVENTION

1. Field of the Invention

In general, the present invention relates to toy vehicles that produce suction to enable the vehicles to travel along vertical walls and move inverted along ceilings. More particularly, the present invention relates to mechanisms contained within such suction wall climbing toys that move the toy from one place to another.

2. Prior Art Description

In the toy industry, the size and cost of motors has decreased dramatically while the power of the motors have either increased or remained the same. The smaller motors are lighter and use less energy than earlier motors. Due to the decrease in weight and power requirements, toys can now be designed and manufactured that would have been impossible only a few decades ago.

One such toy design is the suction wall-climbing toy. Suction wall climbing toys contain a fan that is powered by a small lightweight motor. The fan draws air in from the bottom of the toy. This creates a low-pressure zone under the toy. The low-pressure zone is sufficient enough to hold the weight of the toy against a flat surface. Consequently, the toy can climb up walls and can even run inverted along a ceiling. Such prior art toy devices are exemplified by U.S. Pat. No. 5,014,803 to Urakami, entitled Device Capable Of Suction Adhering To A Wall Surface And Moving Therealong; U.S. Patent Publication No. 2006/0144624 to Clark, entitled Wall Racer Toy Vehicle; U.S. Pat. No. 4,971,591 to Raviv, entitled Vehicle With Vacuum Traction; and U.S. Pat. No. 5,194,032 to Garfinkel, entitled Mobile Toy With Zero-Gravity System.

The main problem associated with suction toys is that of weight. The suction created by the toy must be sufficient to counteract the weight of the toy. In this manner, the toy will not fall from of a ceiling or wall. However, the toy must contain a fan, wheels, drive motors, control circuits, and batteries. Furthermore, the toy must contain a housing strong enough to protect these elements from repeated falls from a high ceiling to a hard tile floor.

Consequently, when designing a suction toy, every effort is made to minimize the size and weight of the components. The result is a small fragile toy that contains no auxiliary or extraneous elements that would increase the mass of the toy. Consequently, prior art suction toys tend to have very spartan, lightweight bodies.

Many novelty items, such as spiders and superheroes could be marketable as suction wall climbing toys. However, in order to make a suction wall climbing toy look anything like a spider or superhero, the toy must have extraneous elements, such as arms, legs, a head, and the like. A need therefore exists for a way to produce a suction wall-climbing toy with extraneous elements without significantly increasing the mass of the toy assembly. A need also exists for a manner of creating movements in the extraneous elements without requiring the need for additional motors or other densely weighted components. These needs are met by the present invention as described and claimed below.

SUMMARY OF THE INVENTION

The present invention is a suction toy assembly and its method of operation. The suction toy assembly has a chassis. The chassis has a front end, a rear end, side surfaces and a base plate. A fan opening is formed through the base plate. A curtain is provided that extends from the base plate. The curtain defines the periphery of an area under the base plate.

A motorized fan is mounted proximate the fan opening. The fan draws air through the fan opening, therein creating a low-pressure condition within the area defined by the curtain. A first drive wheel is provided to propel the suction toy assembly along a flat surface. The drive wheel is rotated by a drive motor. A linkage element is coupled to the drive wheel, or an internal gearbox that is turned by drive motor. The linkage element is moved by the drive motor via the wheel or gearbox.

At least one extraneous element is provided that protrudes outwardly away from the chassis as a cantilever. The extraneous element is articulated by movements of the linkage element as the drive wheel rotates, or the suction toy assembly moves. The suction toy assembly therefore appears to crawl as the extraneous elements move in combination with the movements of the chassis.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention suction toy assembly can be embodied in many ways, the three embodiments illustrated show the assembly configured as a spider, a superhero and as a disembodied hand. These embodiments were selected in order to set forth some of the best modes contemplated for the invention. The illustrated embodiments, however, are merely exemplary and should not be considered a limitation when interpreting the scope of the appended claims.

Figure 1:
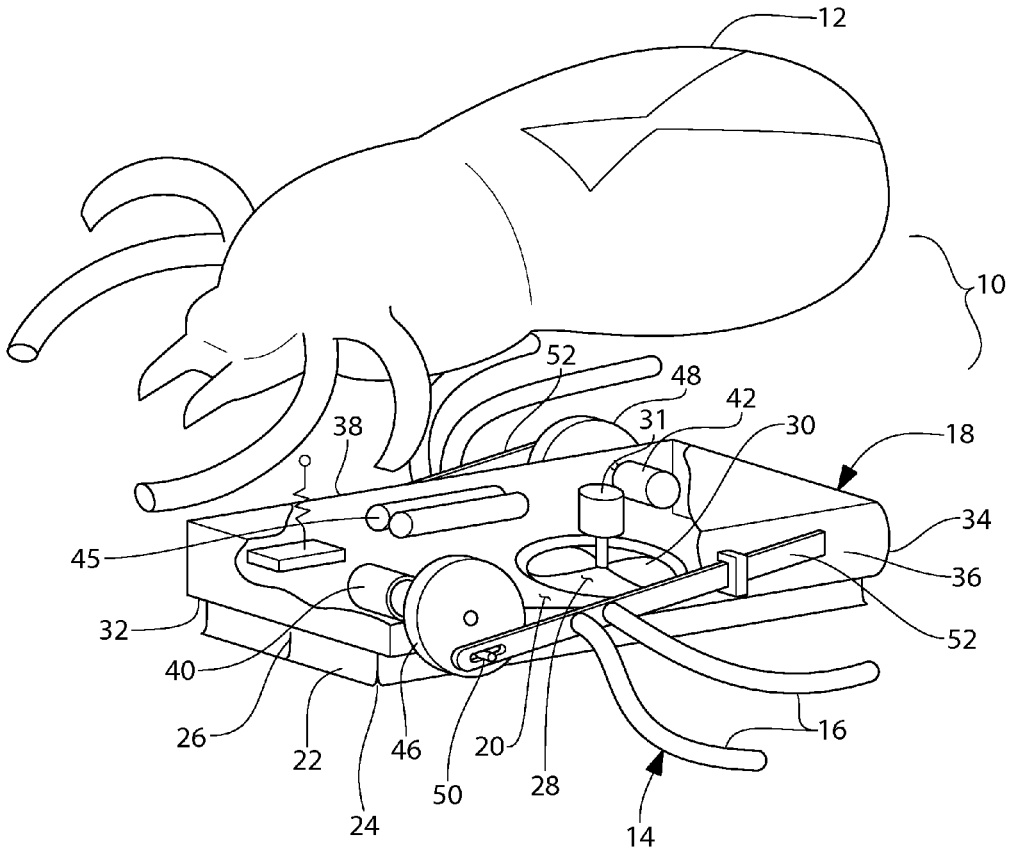
FIG. 1 is an explodes perspective view of an exemplary embodiment of the present invention suction toy assembly.

Referring to FIG. 1, a first exemplary embodiment of the suction toy assembly 10 is shown. In this embodiment, the suction toy assembly 10 is configured with a body shell 12 that is configured as a spider. The spider has extraneous elements 14, in the form of legs 16, that appear to extend outwardly from the body shell 12. The legs 16 on either side of the body shell 12 are articulated so that the legs 16 move as the suction toy assembly 10 travels from place to place along a surface.

The suction toy assembly 10 has a chassis 18 under the body shell 12. The chassis 18 holds the various functional components needed for the operation of the suction toy assembly 10. At the bottom of the chassis 18 is a base plate 20. A flexible curtain 22 extends downwardly from the base plate 20. The flexible curtain 22 defines the periphery around a suction area 24. The flexible curtain 22 is not continuous. Rather, at specific points along it length, breaches 26 are formed in the flexible curtain 22 that enable air to flow past the flexible curtain 22 and into the suction area 24 from all directions. The position and the size of the breaches 26 limit the flow rate of air that can flow past the flexible curtain 22.

An opening 28 is disposed in the base plate 20. A fan 30 is mounted within that opening 28. The fan 30 draws air up from the suction area 24 below the base plate 20. It will therefore be understood that when the fan 30 is activated, the fan 30 draws air and creates a low pressure within the suction area 24. The pressure differential within the suction area 24 is determined by the draw strength of the fan 30 and the air permeability of the flexible curtain 22 as it rests upon a flat surface. The pressure differential must be at least great enough to create a suction force that is greater than the weight of the entire suction toy assembly 10. In this manner, the suction toy assembly 10 can self adhere to a wall or ceiling and operate in a vertical or fully inverted orientation without falling to the ground.

The base plate 20 is the bottom surface of the chassis 18. The chassis 18 has a front edge 32, a rear edge 34, and two sides 36, 38, in addition to the base plate 20. The chassis defines an interior 18. Within the interior is the fan 30 and the motor 31 that powers that fan. In addition, a forward drive motor 40 and a rearward drive motor 42 are provided. Batteries 45 are provided to power the fan 30 and the two drive motors 40, 42. The operation of the fan 30 and drive motors 40, 42 is selectively controlled by a control circuit 44 that is remotely operated by transmitted radio signals or infrared signals.

Two drive wheels 46, 48 are provided. A forward drive wheel 46 extends from the side 36 of the chassis 18 toward the front edge 32 of the chassis 18. Likewise, a rearward drive wheel 48 extends from the opposite side 38 of the chassis 18 toward the rear edge 34 of the chassis 18. Both drive wheels 46, 48 extend below the base plate 20 and terminate in the same plane as the free edges of the flexible curtain 22. The two drive wheels 46, 48 are not centrally mounted to the chassis 18. Rather, one of the two drive wheels 46 is mounted toward the front edge 32 of the chassis 18 and the other drive wheel 48 is mounted toward the rear edge 34 of the chassis 18.

Each of the drive wheels 46, 48 is selectively turned by the drive motors 40, 42, respectively. The drive motors 40, 42 are powered by the batteries 45. Each of the drive wheels 46, 48 has an eccentric pin 50 extending outwardly from its exterior. A linkage element 52 is provided for each drive wheel 46, 48. Each linkage element 52 has one end that connects onto the eccentric pin 50 extending from one of the drive wheels 46, 48. Furthermore, a guide 54 extends outwardly from each side of the chassis 18. Each linkage element 52 passes through the guide 54, thereby limiting the linkage element 52 to a predetermined range of motion.

At least one extraneous element 14 is provided. Each extraneous element 14 is mounted as a cantilever so that the extraneous element 14 is supported above the surface on which the suction toy assembly 10 is moving. Accordingly, the extraneous element 14 does not touch the surface and provides no friction in resistance to the movement of the suction toy assembly 10. the extraneous elements 14 can be rigid plastic piece. However, the extraneous elements 14 are preferably flexible, or contain pivoting joints so that the extraneous elements 14 have complex movements as the suction toy assembly 10 moves.

Figure 2:
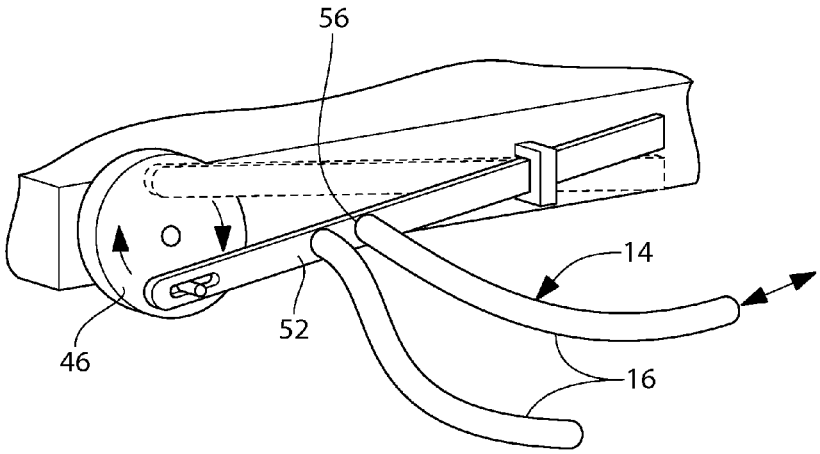
FIG. 2 is fragmented perspective view of a drive wheel section of the chassis from the embodiment of FIG. 1.

In the exemplary embodiment of FIG. 1, an extraneous element 14, such as a leg or arm, is affixed to the linkage element 52 at an attachment point 56. Referring to FIG. 2 in conjunction with FIG. 1, it will be understood that as the drive wheels 46, 48 turn, the linkage elements 52 move both back and forth and up and down. This causes the attachment point 56 to move through an elliptical pattern of movement. In the shown embodiment, the extraneous elements 14 are spider legs 16. Accordingly, as the drive wheels 46, 48 turn, the spider legs 16 move along an elliptical pattern that moves them both forward and backward, up and down.

Figure 3:
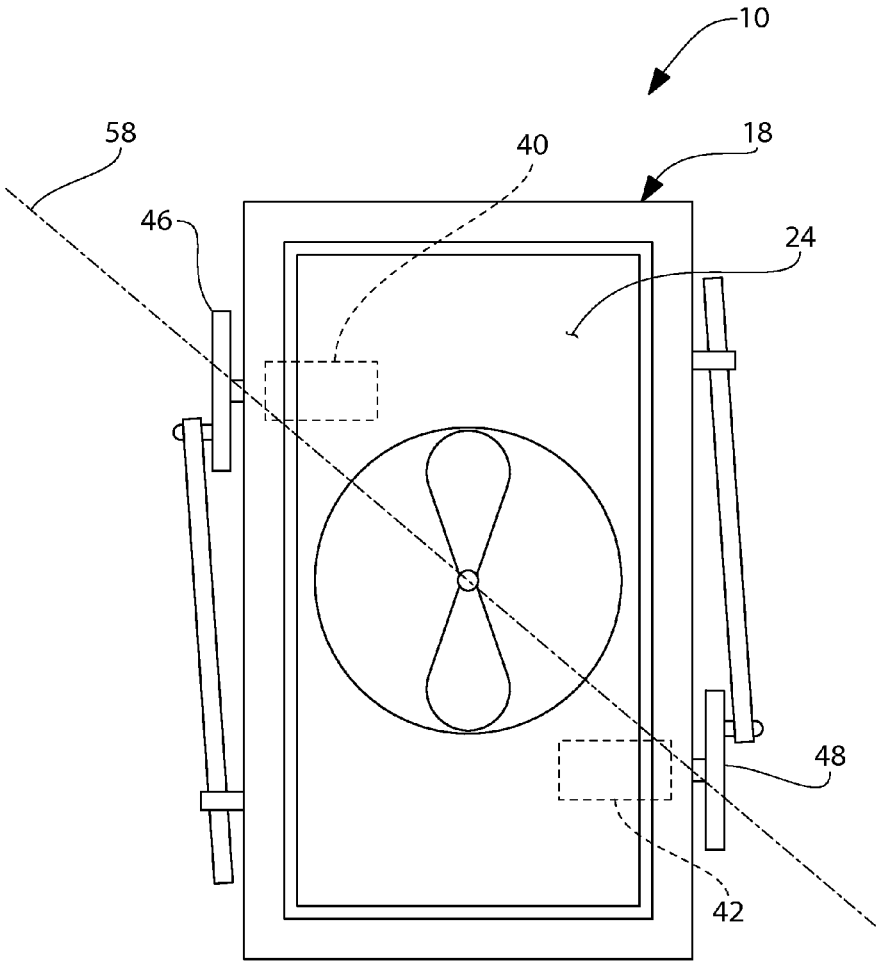
FIG. 3 is a bottom view of the exemplary chassis shown in FIG. 1.

Referring to FIG. 3, it can be seen that the two drive wheels 46, 48 are not aligned with the center of the chassis 18. Rather, one drive wheel 46 is located toward the front of the chassis 18, while the other is located toward the rear of the chassis 18. The two drive wheels 46, 48 and the fan 30 align along a common diagonal line 58 across the chassis 18. The front/rear diagonal offset of the drive wheels 46, 48 is highly beneficial to the operations of the suction toy assembly 10. The front/rear diagonal offset of the drive wheel 46, 48 enables the drive motors 40, 42 within the chassis 18 to also be offset. The chassis 18 is therefore more balanced with a drive motor 40 toward the front, a drive motor 42 toward the rear and the fan 30 in the center. Furthermore, due to the offset of the drive wheels 46, 48, the suction toy assembly 10 is balanced about the diagonal line 58 that passes through the two drive wheels 46, 48 and fan 30. The long diagonal provides a long line of balance for the chassis 18. As a result, the chassis 18 is more stable and it is less likely that one part of the suction area 24 will attract to a surface with more force than any other part.

Lastly, by placing the two drive wheels 46, 48 along the imaginary diagonal 58, it will be understood that unless the wheels are activated in perfect synchronicity, the chassis 18 will quickly turn away from whichever drive wheel 46, 48 is activated. The two drive wheels 46, 48 are powered by different drive motors 40, 42. The drive motors 40, 42 are individually controlled by remote control. Accordingly, the drive motors 40, 42 are not always synchronized and the suction toy assembly 10 is likely to have a tendency to move from side-to-side in a serpentine pattern 60 even when an operator is attempting to move the suction toy assembly 10 along a straight line.

In the embodiment of FIG. 1, the suction toy assembly 10 is constructed in the appearance of a spider. As the suction toy assembly 10 moves along a surface, the legs 16 on the sides of the suction toy assembly 10 move in an elliptical pattern. This causes the overall suction toy assembly 10 to appear to actively crawl. Furthermore, the suction toy assembly 10 moves from side to side as it advances. This further enhances the appearance of crawling.

Figure 4:
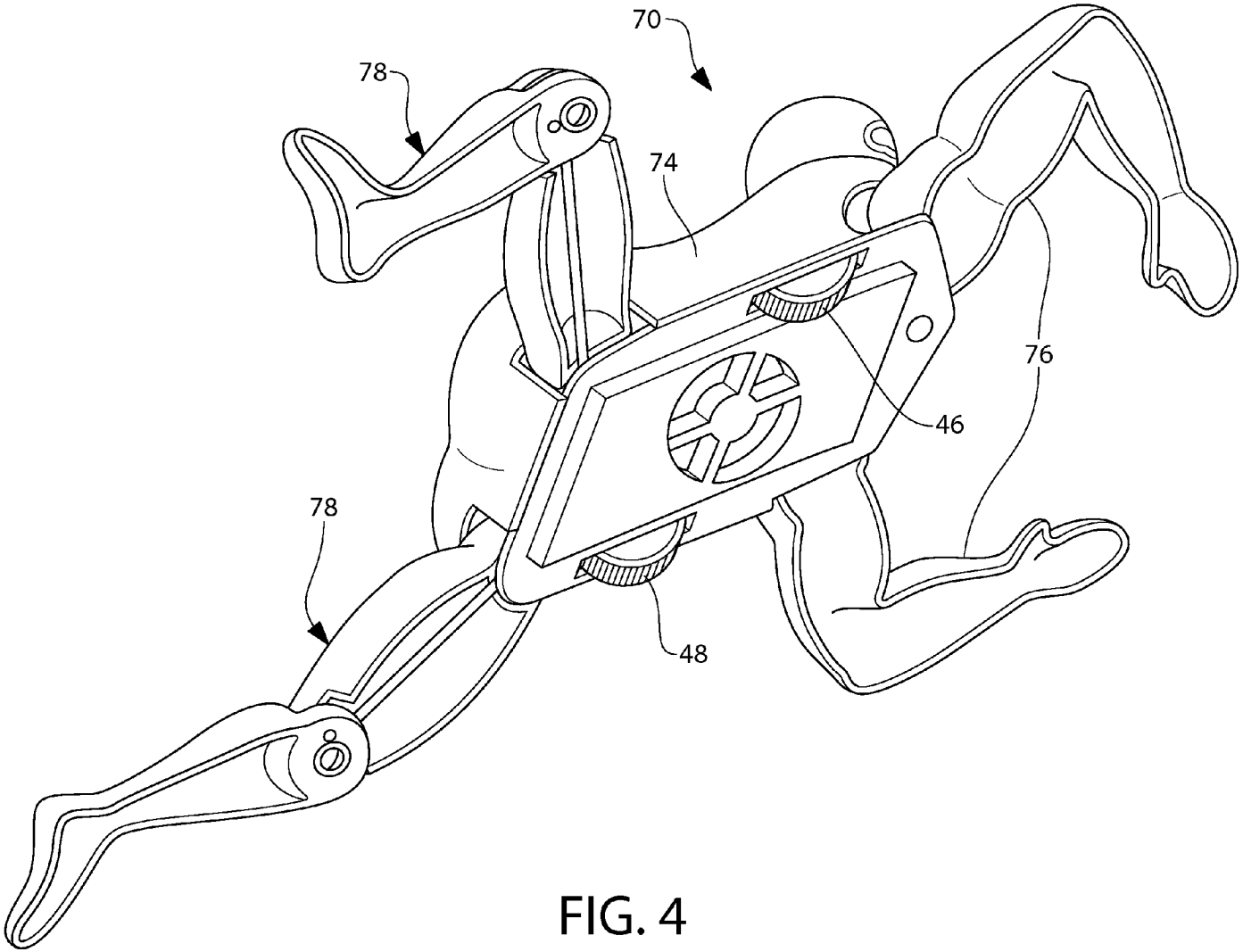
FIG. 4 is a bottom perspective view of an alternate embodiment of the present invention suction toy device embodied as a superhero.
Figure 5:
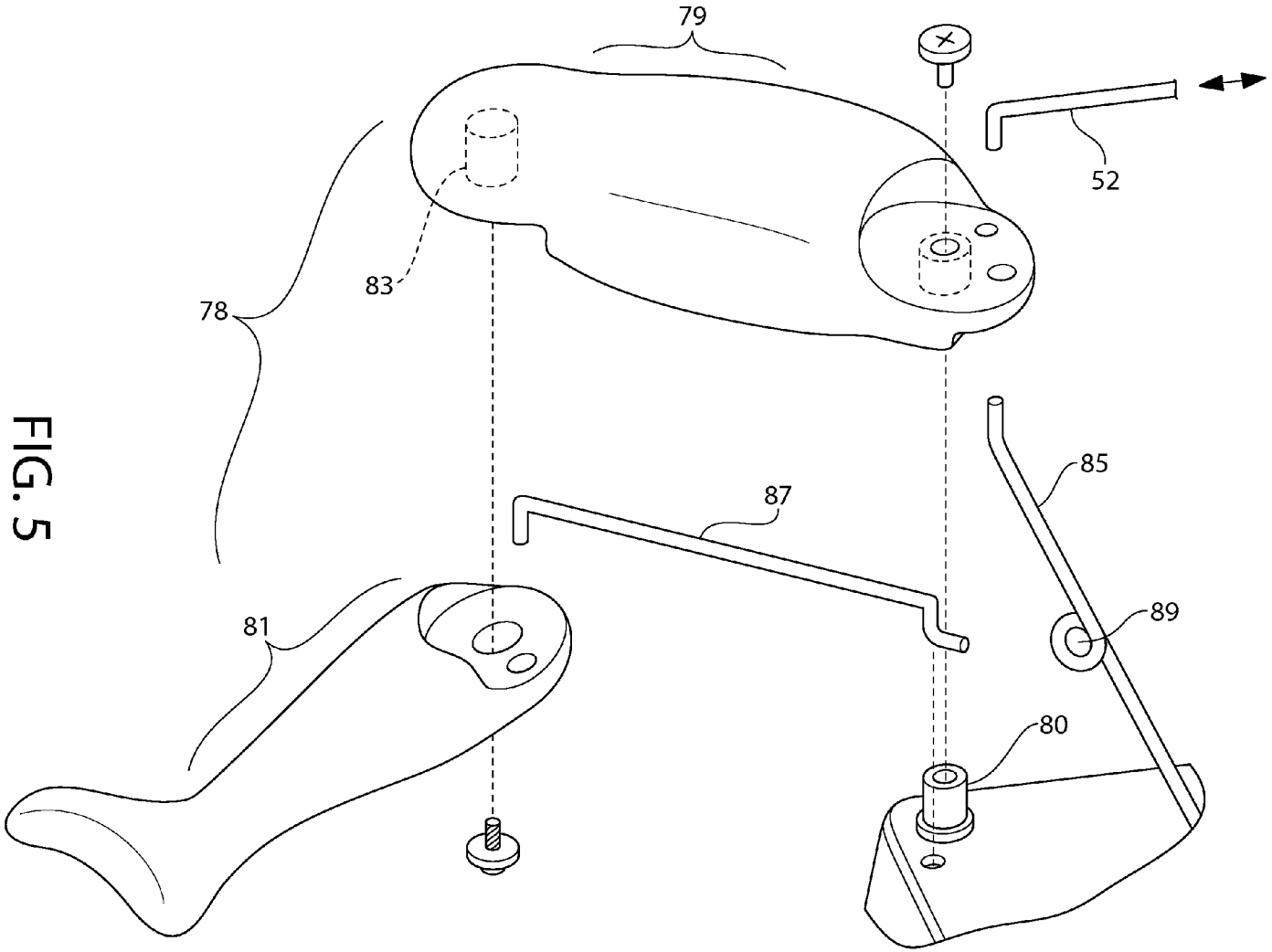
FIG. 5 is a localized exploded view showing the movement of arm and leg components within the exemplary embodiment of FIG. 4.

Referring now to FIG. 4 and FIG. 5, an alternate embodiment of a suction toy device 70 is shown. In this embodiment, the suction toy assembly 70 is configured as a climbing superhero 72. The superhero 72 has a main body segment 74 that is shaped as a torso. A set of arms 76 and a set of legs 78 are connected to the main body segment 70 with pivot joint connections 80. In this manner, the arms 76 and the legs 78 can move from side to side about the pivot joint connections 80.

The suction toy assembly 70 has functional components identical to those previously described. Accordingly, the same reference numbers will be used to describe the same component parts. A linkage element 52 is attached to each of the drive wheels 46, 48. As the drive wheels 46, 48 turn, the linkage elements 52 move back and forth as the drive wheels 46, 48 turn. It is this reciprocating motion of the linkage elements 52 that is used to cause the arms 76 and the legs 78 to rock back and forth.

As shown in FIG. 5, the leg 78 is held in place by a single pivot joint connection 80. The leg 78 is also attached to the linkage element 52. As the linkage arm element 52 moves back and forth, the leg 78 is tilted about the pivot joint connection 80. The leg 78 will therefore move from side to side as the suction toy assembly 70 travels. This articulated motion of the leg 78 gives the appearance that the superhero 72 is crawling or climbing as it travels from one point to another.

The leg 78 can be comprised of multiple pieces. In the shown embodiment, the leg has an upper section 79 and a lower section 81 that are joined together by a pivot joint 83. In this manner, the upper section 79 and the lower section 81 of the leg 78 can move independently.

The movements of the upper leg 83 are directly controlled by the movement of the linkage element 52. The lower leg can hang freely or can also be actively articulated. Articulation linkages 85, 87 can be provided. The first articulation linkage 85 interconnects the two upper sections 79 of the two legs 78. In this manner, when one leg is moved by a drive wheel, the two legs 78 move together in a synchronized manner. The lower leg segments 81 are attached to a second articulation linkage 87. The second articulation linkage 87 connects to a loop 89 in the first articulation linkage 85. In this manner, the upper section 79 and the lower section 81 of the two legs all are articulated and all move in a synchronized manner than mimic crawling.

It will be further understood that although FIG. 5 shows only a leg 78, the arms 76 would be articulated in the same manner using the linkage elements 52 from the opposite drive wheel.

Figure 6:
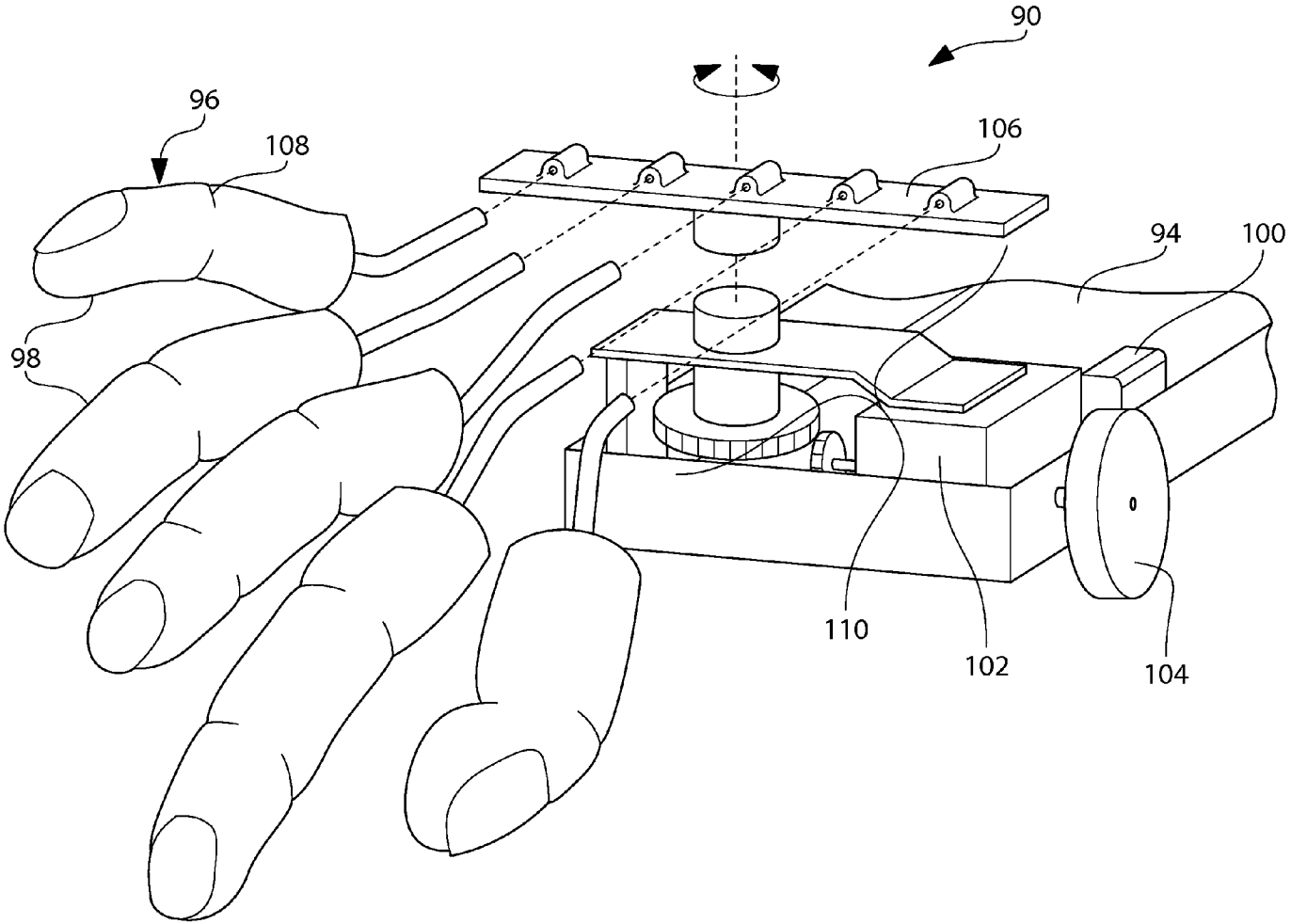
FIG. 6 is a fragmented perspective view of another alternate embodiment of the present invention suction toy device embodies as a hand with moving fingers.

Referring now to FIG. 6, a partial view of a second alternate embodiment of a suction toy device 90 is shown. In this embodiment, the suction toy assembly 90 is configured as a disembodied hand. A chassis 94 is provided. The chassis 94 is covered by a shell (not shown) that is shaped as a human hand. The extraneous elements 96 that are to be articulated are the fingers 98 of the hand.

In this embodiment, a drive motor 100 is provided. The drive motor 100 drives a gear box 102. The gear box 102 turns a drive wheel 104. The gearbox also creates reciprocating rotational movements in a support plate 106. The various fingers 98 are all connected to the support plate 106. The chassis 94 with pivot connections 95. In this manner, the various fingers 98 will move back and forth back and forth and otherwise appear to move as the suction toy device 90 travels.

The various fingers 98 are suspended as cantilevers from the support plate 106. However, each finger can contain one or more joints 108 along its length. This enables the each finger to bend at various at the joints 108. This makes the fingers 98 move more realistically as the suction toy device 90 travels.

The gearbox 102 and support plate 106 combine to create an articulation mechanism 110 that causes movements in the various fingers 98. The articulation mechanism can be many mechanical devices other than what is shown. A variety of gearboxes can be used. Likewise, a cam-based articulation mechanism can be substituted for the gearbox 102. All such articulation mechanisms are designed to move the various fingers 98 as the suction toy assembly 90 travels. This articulated motion of the fingers 98 provides the appearance that the assembly 90 is crawling or climbing as it travels from one point to another.

It will be understood that the embodiment of the present invention that is illustrated and described is merely exemplary and that a person skilled in the art can make many variations to those embodiments. For instance, the body shell can be shaped as many items other than a spider, superhero, or hand. For example, the body shell can be configured as a crab or a monster. Likewise the extraneous elements that are articulated can take on many forms. All such embodiments are intended to be included within the scope of the present invention as defined by the claims.

What is claimed is:

1. A suction toy assembly, comprising:

a chassis having a front end, a rear end, side surfaces and a base plate, wherein a fan opening is formed in said base plate;

a curtain extending from said base plate and defining a periphery of an area;

a motorized fan mounted proximate said fan opening to draw air from all directions into said fan opening from said area, therein creating a low pressure condition within said area;

a first drive wheel rotated by a first drive motor, wherein a pin extends outwardly from said first drive wheel in an eccentric position;

a guide that extends outwardly from one of said side surfaces of said chassis;

a linkage element having a first end coupled to said pin on said first drive wheel, wherein said linkage element extends through said guide and is moved through a predetermined range of motion by said pin when said first drive wheel rotates; and at least one extraneous element that protrudes outwardly away from said chassis that is articulated by said linkage element when said first drive wheel rotates and said linkage element moves through said predetermined range of motion.

2. The assembly according to claim 1, further including a second drive wheel rotated by a second drive motor.

3. The assembly according to claim 2, wherein said first drive wheel extends from one of said side surfaces of said chassis and said second drive wheel extends from said chassis from an opposite of said side surfaces.

4. The assembly according to claim 3, wherein said first drive wheel, said second drive wheel and said fan are linearly aligned along a common diagonal line.

5. The assembly according to claim 1, wherein said at least one extraneous element is anchored to said linkage element and moves with said linkage element.

6. The assembly according to claim 1, wherein said at least one extraneous element is coupled to said chassis with a pivotable connection, wherein said linkage element moves said at least one extraneous element about said pivotable connection as said linkage element moves through said range of motion.

7. The assembly according to claim 1, wherein said first drive wheel moves said chassis along a surface and said at least one extraneous element is supported above said surface without contacting said surface.

8. The assembly according to claim 1, wherein said at least one extraneous element is configured as a body appendage, selected from a group consisting of arms, legs, a head, a tail, and fingers.

9. The assembly according to claim 1, wherein said chassis is configured as a spider body and said at least one extraneous element is configured as a spider leg.

10. A toy hand assembly with articulating fingers that moves along a flat surface, said assembly comprising;

a body having an exterior shaped as a human hand;

a fan supported within said body for creating a low pressure area under said body;

a first drive wheel for propelling said body along the flat surface, wherein said first drive wheel is powered by a drive motor;

a plurality of fingers extending outwardly away from said body; and an articulation mechanism powered by said drive motor that causes movements in said plurality of fingers as said drive motor turns said first drive wheel.

11. The assembly according to claim 10, further including a second drive wheel, wherein said first drive wheel and said second drive wheel are mounted to opposite sides of said body.

12. The assembly according to claim 11, wherein said first drive wheel, said second drive wheel and said fan are linearly aligned along a common diagonal of said body.

13. The assembly according to claim 10, wherein said articulation mechanism is a linkage attached to said first drive wheel, wherein said plurality of fingers said linkage and moves with said linkage.

14. The assembly according to claim 10, wherein said articulation mechanism is a gearbox attached to said drive motor, wherein said at least one appendage is moved by said gearbox when said drive motor is in operation.

15. A method of articulating an appendage on a wall crawling suction toy, comprising the steps of:

providing a body;

providing a fan within said body for creating a low pressure area between said body an a vertical surface sufficient to prevent said body from falling away from said vertical surface;

providing a drive wheel having a pin extending outwardly from said first drive wheel in an eccentric position;

providing a drive motor within said body that turns said drive wheel, therein propelling said body along said vertical surface;

attaching a linkage element to said pin on said drive wheel, wherein said linkage element is moved by said drive wheel through a predetermined range of motion;

attaching said appendage to said body with a pivot joint;

moving said appendage with said linkage element, therein causing said appendage to rotate about said pivot joint.

16. The method according to claim 15, wherein said appendage has two ends and is capable of flexing in at least one point between said ends.

* * * * *